United States Patent [19]

Suzuki et al.

[11] Patent Number: 5,035,052

[45] Date of Patent: Jul. 30, 1991

[54] METHOD OF ASSEMBLING A HEAT EXCHANGER INCLUDING A METHOD OF DETERMINING VALUES OF PARAMETERS IN A HEAT EXCHANGER, AND DETERMINING WHETHER THE EFFICIENCY OF THE HEAT EXCHANGER IS ACCEPTABLE

[75] Inventors: Yoshio Suzuki, Nishikamo; Michio Hiramatsu, Anjo, both of Japan

[73] Assignee: Nippondenso Co., Ltd., Kariya, Japan

[21] Appl. No.: 489,189

[22] Filed: Mar. 8, 1990

[30] Foreign Application Priority Data

Mar. 8, 1989 [JP] Japan ..... 1-55610

[51] Int. Cl.[5] ..... B23P 15/26

[52] U.S. Cl. ..... 29/890.046; 29/407; 29/428; 165/185

[58] Field of Search ..... 29/407, 890.048, 890.046, 29/428, 426.1; 165/184, 185; 73/112-116

[56] References Cited

U.S. PATENT DOCUMENTS 4,332,293 6/1982 Hiramatsu .

FOREIGN PATENT DOCUMENTS 58-148486 10/1983 Japan .
61-46756 10/1986 Japan .
61-57556 12/1986 Japan .
62-18858 5/1987 Japan .
63-37876 7/1988 Japan .

*Primary Examiner*—Irene Cuda
*Attorney, Agent, or Firm*—Cushman, Darby & Cushman

[57] ABSTRACT

A method of assembling a heat exchanger including a method of determining the parameters Pl, Pf, $\beta$, and $\Theta$ in a heat exchanger wherein Pl is the width of a louver formed in a fin of the heat exchanger, Pf is the fin pitch, $\beta$ is the tilt angle of the fin and $\Theta$ is the tilt angle of the louver. The values of these parameters are determined so as to satisfy the expression $$0.2 \leqq \frac{Pl}{Pf}(\tan\beta + \tan\theta) \leqq 0.45$$

When the expression is satisfied, the efficiency of the heat exchanger is acceptable.

8 Claims, 20 Drawing Sheets

$P_f/P_\ell = 1.5$ $\theta = 25°$ $Re = 100$ $P_f/P_\ell = 1.5$ $\theta = 25°$ $Re = 250$ $P_f/P_\ell = 1.5$ $\theta = 25°$ $Re = 500$ $\ell 2/\ell 1 = 0.7$ $Pf/P\ell = 1$ $Re = 250$ $\ell 2/\ell 1 = 0.5$ $Pf/P\ell = 1$ $Re = 250$ $\ell 2/\ell 1 = 0.4$ $Pf/P\ell = 1$ $Re = 250$ $\ell 2/\ell 1 = 0.3$ $Pf/P\ell = 1$ $Re = 250$ $\beta = 0'$, $\theta \neq 0'$ $\beta \neq 0'$, $\theta \neq 0'$ $\beta \neq 0'$, $\theta \neq 0'$ FIG. 19
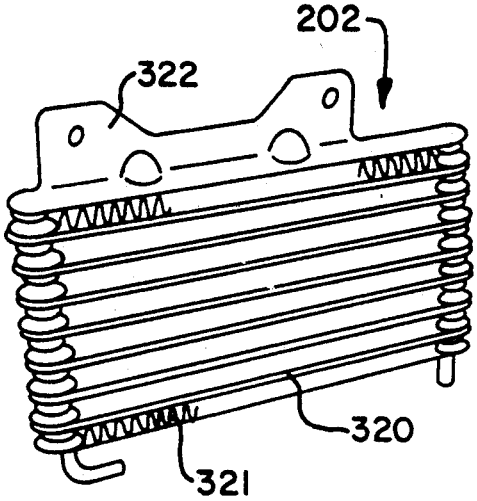
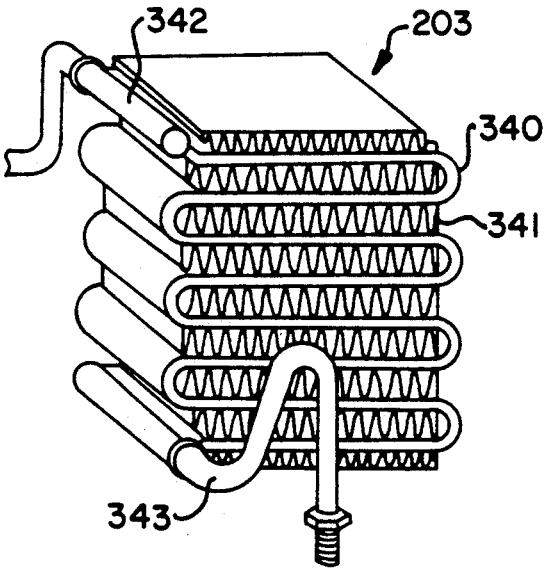
FIG. 20
FIG. 21
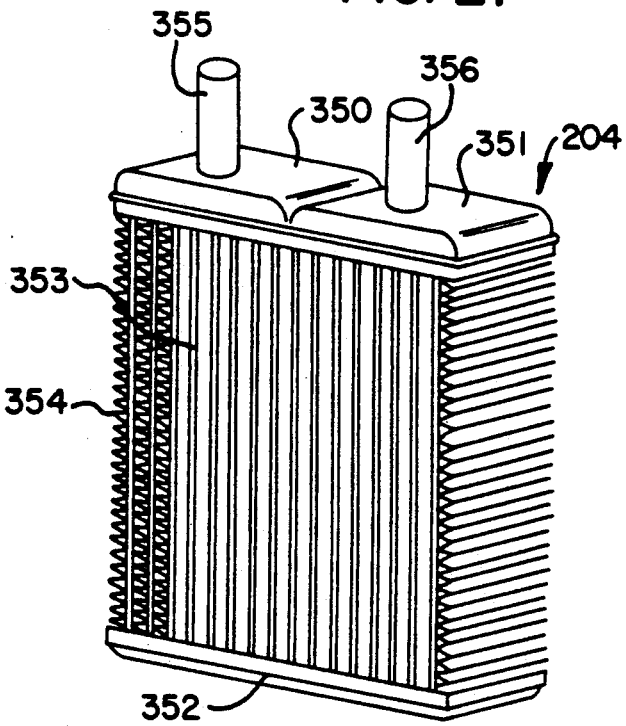

METHOD OF ASSEMBLING A HEAT EXCHANGER INCLUDING A METHOD OF DETERMINING VALUES OF PARAMETERS IN A HEAT EXCHANGER, AND DETERMINING WHETHER THE EFFICIENCY OF THE HEAT EXCHANGER IS ACCEPTABLE

FIELD OF THE INVENTION

The present invention is applied to a heat exchanger which is used as, for example, a radiator, a heater, or an evaporator for an automobile.

PROCESS OF THE INVENTION

The flow of air flowing through louvers formed on fins of a heat exchanger is found to affect the heat transfer efficiency of a heat exchanger according to the present inventors' examinations of the heat transfer efficiency of a heat exchanger having louvered fins as shown in Japanese Patent (Kokoku) No. 61-46756. The result as shown in FIGS. 2(*a*)–(*f*) was obtained by making the air-flow visible. FIGS. 2(*a*) through 2(*c*) shows streamlines of air flowing through louvers, wherein the shapes of the fins are all the same but the velocities of air-flow in each figure is different. In FIGS. 2(*a*) through 2(*f*), the solid streamlines are given by a simulation and the broken streamlines show real locus of air-flow. Both of the streamlines are almost coincident with each other. In FIGS. 2(*a*) through 2(*c*), the ratio of the fin pitch Pf to the width Pl of the louvers is 1 to 1, the tilt angle of the fins is 0° and the tilt angle of the louvers is 25°. As shown in FIGS. 2(*a*) through 2(*c*), the streamlines are variable according to the velocity of the streams even though the shapes of the fins are the same.

FIGS. 2(*d*) through 2(*f*) show streamlines wherein the velocities of the streams are different from each other and the shapes of the fins are the same. The velocities of streams in FIGS. 2(*d*) through 2(*f*) are the same as the velocities in FIGS. 2(*a*) through 2(*c*). In FIGS. 2(*d*) through 2(*f*), the ratio of the fin pitch Pf to the width Pl of the louvers is 1.5 to 1, the tilt angle of the fins is 0° and the tilt angle of the louvers is 25°. Throughout this specification the fin and louver tilt angles are taken relative to the initial or incoming direction of air flow.

The fin pitch Pf, the width Pl of the louvers and the velocity of streams affect the streamlines of air passing through the louvers of the fins as compared to the streamlines shown in FIGS. 2(*a*) through 2(*c*) and the streamlines shown in FIGS. 2(*d*) through 2(*f*).

FIG. 3 shows the stream of air flowing through the louvers microscopically. A boundary area 10 is formed on the surface of the louvers, so that the areas of air flow passes BC between fins and passes AB between louvers are decreased, and it becomes harder for the air to flow through the louvers. The velocity of air, the width of the louvers and so on affect the forming of the boundary area 10, and the tilt angles of the fins and louvers as well as the fin pitch Pf and the width of the louvers affect the width of each pass.

The inventors have also conducted research on the effect of the fin tilt angle and the lower tilt angle Θ on the streamlines.

FIG. 4 shows the relation of the tilt angle Θ of the louvers, the thermal conductivity Nu and a coefficient of flowing resistance Cf. The axis of abscissas represents the lower tilt angle Θ from 5° through 45°. The fin tilt angle is fixed as 0°. The axis of ordinates represents the Nusselt number (Nu) and a coefficient of flowing resistance Cf. The Nusselt number (Nu) is the heat transfer index. The coefficient Cf shows a resistance of air flowing through fins. The Nusselt number and the coefficient Cf are defined as follows:

$$Nu = \frac{\alpha Pl}{\lambda}$$

$$Cf = \frac{\Delta P}{\frac{1}{2}\rho U^2_o} \times \frac{2Pf}{4L}$$

wherein α represents the heat transfer coefficient of the fins, λ represents the thermal conductivity of air, ΔP represents air resistance (pressure drop), η represents the density of air, Uo represents the velocity of air and L represents the whole length of a fin.

As shown in FIG. 4, there is a correlation between the louver tilt angle Θ and the coefficient of flowing resistance Cf. There is no certain relation between the louver tilt angle Θ and Nusselt number (Nu).

The louver tilt angle Θ is not always constant in manufactured goods. The present inventors found that when the fins are intended to have a louver tilt angle of Θ is 25°, the actual louver tilt angle varies from 19° through 30°. FIG. 5 shows a dispersion of the louver tilt angle Θ in manufactured heat exchangers, the ordinate being the number fi of louvers with a given tilt angle divided by the total number N. The louver tilt angle Θ is on a normal curve. The average tilt angle is 24.6° and the deviation is 2.17°.

If the louver tilt angle Θ is determined, the streamlines of the air flowing through louvers is determined approximately.

According to the result shown in FIG. 4, the louver tilt angle Θ affects the streamlines of air flowing through the fins; however, they are not determined only by the louver tilt angle. The present inventors examined not only the boundary area 10 on each louver but also the mutual effect of the boundary areas. FIG. 6 shows arrangements of louvers schematically and the effect of the boundary area on the louvers which are located downstream. In FIGS. 6(*a*) and (*c*), the louvers are not affected by the louvers which are located upstream so much and high heat transfer efficiency could be achieved. In FIGS. 6(*b*) and 6(*d*), the streamline behind the louver encounters the other louver which is located downstream, so that the heat transfer efficiency is decreased.

The streamlines of the louvers shown in FIGS. 6(*a*-)–(*d*) were examined by simulation. FIGS. 7(*a*)–(*d*) show the results. In those FIGS., the ratio of the fin pitch Pf to the width Pl of louvers is 1 to 1 and the velocity of air flowing through the louvers is determined in such a manner that Reynolds number is 250. The Reynolds number (Re) is defined as follows:

$$Re = \frac{UoPl}{Ny}$$

wherein Ny is a coefficient of the kinematic viscosity of air.

In FIGS. 7(*a*) through 7(*d*), the ratio of the distance $l_1$ between adjacent louvers to the distance $l_2$ between adjacent fins is different in each figure.

The ratio of $l_1$ to $l_2$ is 1 to 0.7 in FIG. 7(*a*), 1 to 0.5 in FIG. 7(*b*), 1 to 0.4 in FIG. (*c*) and 1 to 0.3 in FIG. 7(*d*).

The ratio of $l_1$ to $l_2$ is explained hereinafter with reference to FIG. 8. The distance $l_1$ stands for the distance between louver 111 of the first fin 101 and louver 112 of the second fin 102. The distance $l_1$ can be replaced by Pfcos Θ. The distance $l_2$ is the distance between adjacent louvers 111 and 121 of fin 101. The distance $l_2$ can be replaced by Pl sin Θ.

FIGS. 7(*a*)–(*d*) show sets of louvers and waveforms illustrating the velocity and the direction of air flowing through the louvers. In FIG. 7(*b*), a louver reduces the velocity of air at the front of the next louver located in line downstream. In FIGS. 7(*a*) and 7(*c*), a louver does not similarly affect the air at the front of the next louver located downstream since they are not in line. In FIG. 7(*d*), the louvers are arranged in such a manner that the first louver and the next louver which is located downstream in the third column of louvers are aligned in an oblique direction; however, the first louver does not affect the streamline at the front of the next aligned louver.

According to the result described above, the louver tilt angle as well as the fin pitch and the louver width should be considered in estimating the efficiency of a heat exchanger.

The ratio of $l_1$ to $l_2$ can be replaced by $$\frac{Pl}{Pf}\tan\theta.$$

FIG. 9 shows the relation of $$\frac{Pl}{Pf}\tan\theta,$$

the Nusselt number Nu and the coefficient of flowing resistance Cf. It is apparent from FIG. 9 that when the value of $$\frac{Pl}{Pf}\tan\theta$$

is around 0.4 and 0.7, the Nusselt number Nu is high but when the value of $$\frac{Pl}{Pf}\tan\theta$$

is around 0.5, the Nusselt number Nu decreases. The result shown in FIG. 9 is coincident with the distribution of velocity of air shown in FIG. 7.

$$\frac{Pl}{Pf}\tan\theta$$

is acceptable as a parameter in estimating the heat transfer efficiency of the heat exchanger. There is a correlation between $$\frac{Pl}{Pf}\tan\theta$$

and the coefficient of resistance Cf. The coefficient of resistance Cf has inflection points and the Nusselt number Nu has a maximum value and a minimum value when the value of $$\frac{Pl}{Pf}\tan\theta$$

is around 0.4 and 0.5, respectively. The coefficient Cf does not reach a maximum value before that range. The reason why the resistance coefficient Cf does not reach such a maximum value is that there is a fluid pressure loss from the friction resistance on the fin surfaces due to the fluid viscosity and another resistance due to the shape of the fins. The resistance due to the shape of fins increases according to the louver tilt angle Θ so that the maximum value of the coefficiency Cf is cancelled, i.e., the maximum value which is suppose to exist when the value of $$\frac{Pl}{Pf}\tan\theta$$

is around 0.4.

The present inventors also examined whether the result shown in FIG. 9 is valid even if the fluid velocity is variable. The result is shown in FIG. 10. The ratio of the fin pitch to the louver width is 1 to 1 and the velocity of fluid flowing through the louvers is varied in such a manner that Reynolds number is 150, 250 and 500. As shown in FIG. 10, since the relation of $$\frac{Pl}{Pf}\tan\theta,$$

Nu and Cf has the same tendency as the result shown in FIG. 9, it is confirmed that the efficiency of the heat exchanger can be estimated by the parameter of $$\frac{Pl}{Pf}\tan\theta.$$

The present inventors then determined the optimum condition of a heat exchanger while considering the heat transfer efficiency and the pressure loss. The parameter $$\frac{jh}{Cf}$$

is used to express the heat transfer efficiency and the pressure loss.

The parameter $$\frac{jh}{Cf}$$

is represented as follows:

$$\frac{jh}{Cf} = \frac{\frac{Nu}{RePr^{\frac{1}{3}}}}{Cf}$$

wherein jh represents the Colburn factor and Pr represents the Prandtl number. FIG. 1 shows the relation of $$\frac{Pl}{Pf}\tan\theta \text{ and } \frac{jh}{Cf}.$$

As shown in FIG. 1, the value of $$\frac{jh}{Cf}$$

is the maximum value when the value of $$\frac{Pl}{Pf}\tan\theta$$

is around 0.3. Hence, the louvers are arranged in the best way when the value of $$\frac{Pl}{Pf}\tan\theta$$

is within 0.3 through 0.4. The heat exchanger can achieve effective heat exchanging when the value of $$\frac{Pl}{Pf}\tan\theta$$

is within the range of about 0.2 through about 0.45.

The present inventors also examined whether the result shown in FIG. 9 is valid even if the fins have a tilt angle as shown in FIG. 11(*b*) or the fins have a tilt angle and the tilt angle of the louvers is 0°, that is, the louvers are parallel to the streams of fluid as shown in FIG. 11(*c*).

The ratio $l_2/l_1$ is explained hereinafter with the reference of FIG. 12 when the fins have the tilt angle $\beta$. The distance $l_1$ represents the distance between a louver 111A which is located in a row of fin 101A and louver 112A which is located in the other adjacent row of fin 102A. The distance $l_2$ represents the distance between adjacent louvers which are located in the same fin row. The distance $l_1$ can be replaced by Pfcos Θ, and the distance $l_2$ can be replaced by Pl(tan $\beta$+tan Θ) cosΘ. Therefore, the ratio $l_2/l_1$ can be replaced by $$\frac{Pl}{Pf}(\tan\beta+\tan\theta).$$

FIG. 13 shows the relation of $$\frac{Pl}{Pf}(\tan\beta+\tan\theta),$$

Nu and Cf. The ratio of the fin pitch to the louver width is 1.0, the velocity of the fluid flowing through the louvers is set in such a manner that the Reynolds number is about 250, and the tilt angle of fin $\beta$ is 0°, 10° and 20°. There is a certain tendency even if the velocity of fluid is different.

In FIG. 14, the ratio of the fin pitch and the louver width is 1.0, and the Reynolds number is about 250. FIG. 14 shows three cases wherein the louver tilt angle Θ is varied, the fin tilt angle $\beta$ is 0° and the louver tilt angle Θ is varied. As shown in FIG. 14, there is a certain tendency even if the fin tilt angle is different. Therefore, it is proved that the efficiency of the heat exchanger can be estimated by the parameter $$\frac{Pl}{Pf}(\tan\beta+\tan\theta).$$

FIG. 15 shows the relation of $$\frac{Pl}{Pf}(\tan\beta+\tan\theta) \text{ and } \frac{jh}{Cf}$$

under the same condition as the result shown in FIG. 14. The value of $$\frac{jh}{Cf}$$

becomes maximum when the value of $$\frac{Pl}{Pf}(\tan\beta+\tan\theta)$$

is around 0.3. The tendency of the result shown in FIG. 15 is almost the same as the result shown in FIG. 1.

SUMMARY OF THE INVENTION

An object of the present invention is to provide a method of determining the values of parameters in a heat exchanger and a method of determining whether the efficiency of a heat exchanger is acceptable plus a method of making and/or assembling a heat exchanger.

According to the present invention, the relation of the fin pitch Pf, the louver width Pl, the fin tilt angle $\beta$ and the louver tilt angle Θ is shown by the expression $$\frac{Pl}{Pf}(\tan\beta+\tan\theta).$$

Each of the parameters of a heat exchanger is determined in such a manner that the value of $$\frac{Pl}{Pf}(\tan\beta+\tan\theta)$$

is within the range of about 0.2 through about 0.45, and the value of $$\frac{Pl}{Pf}(\tan\beta+\tan\theta)$$

shows whether the efficiency of the heat exchanger is acceptable.

Figure 11A:
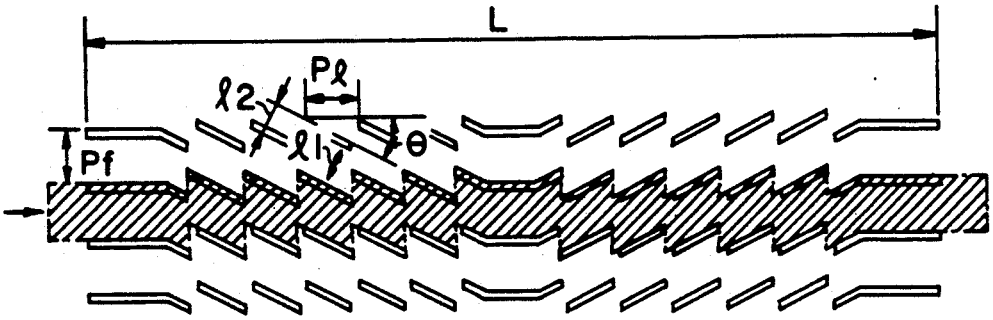
Figure 11B:
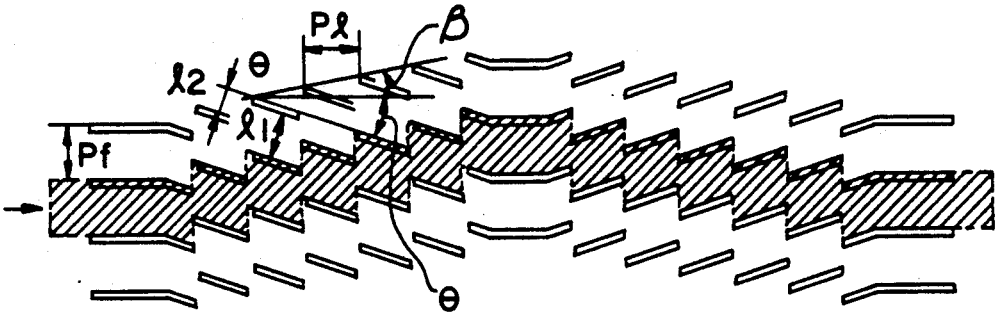
Figure 11C:
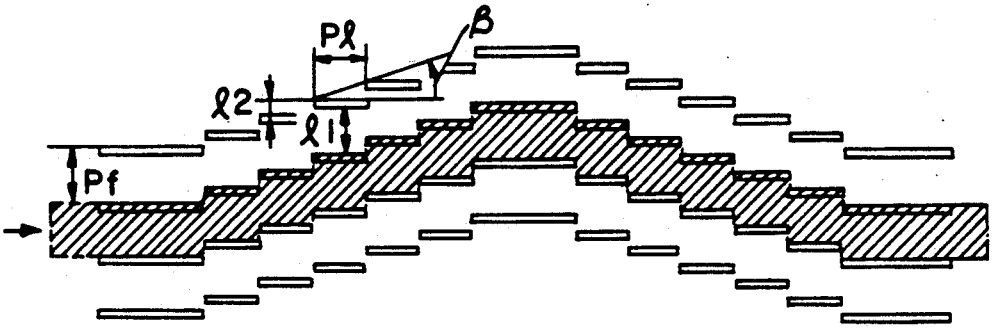
Figure 12:
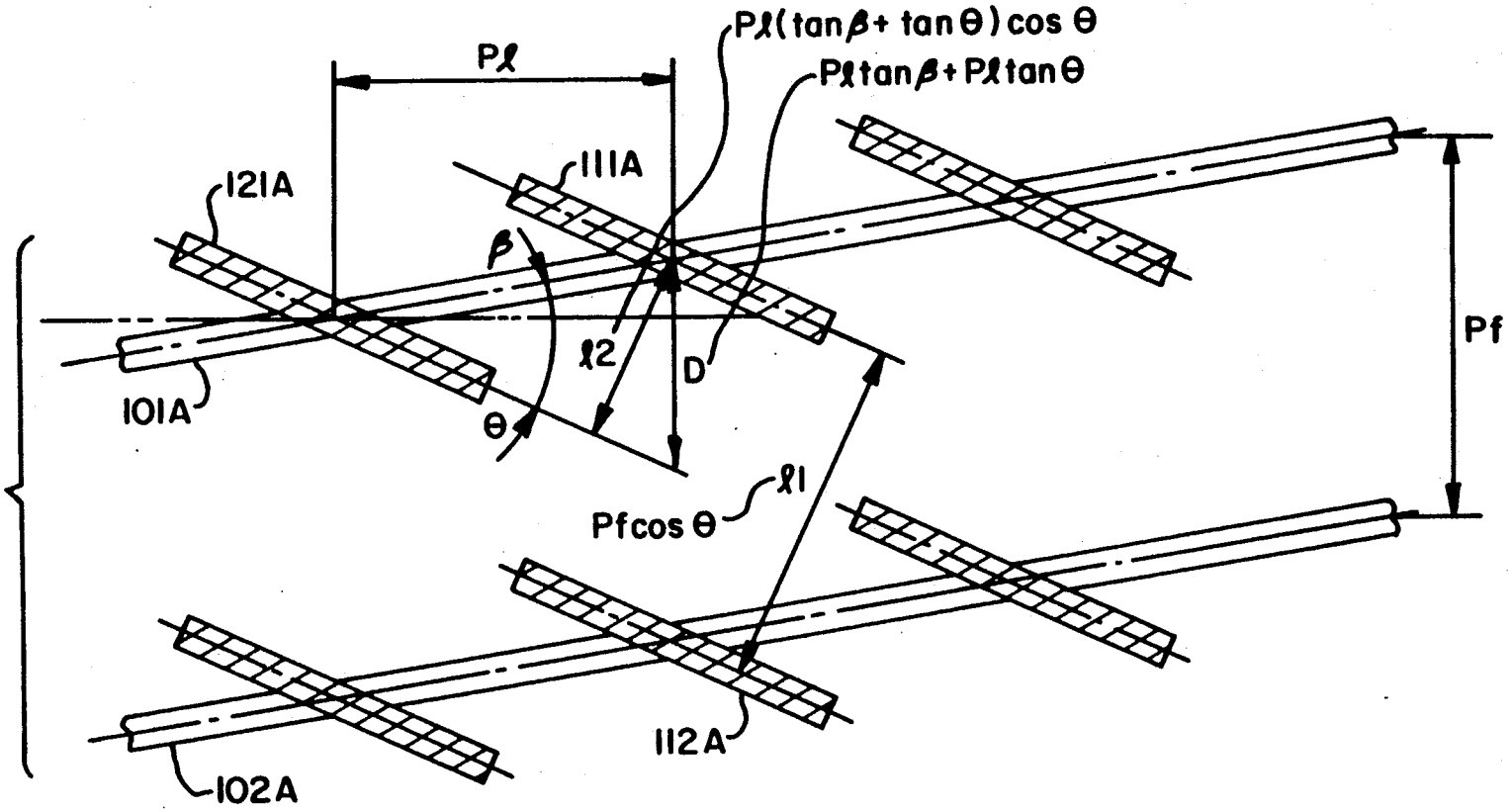
Figure 13:
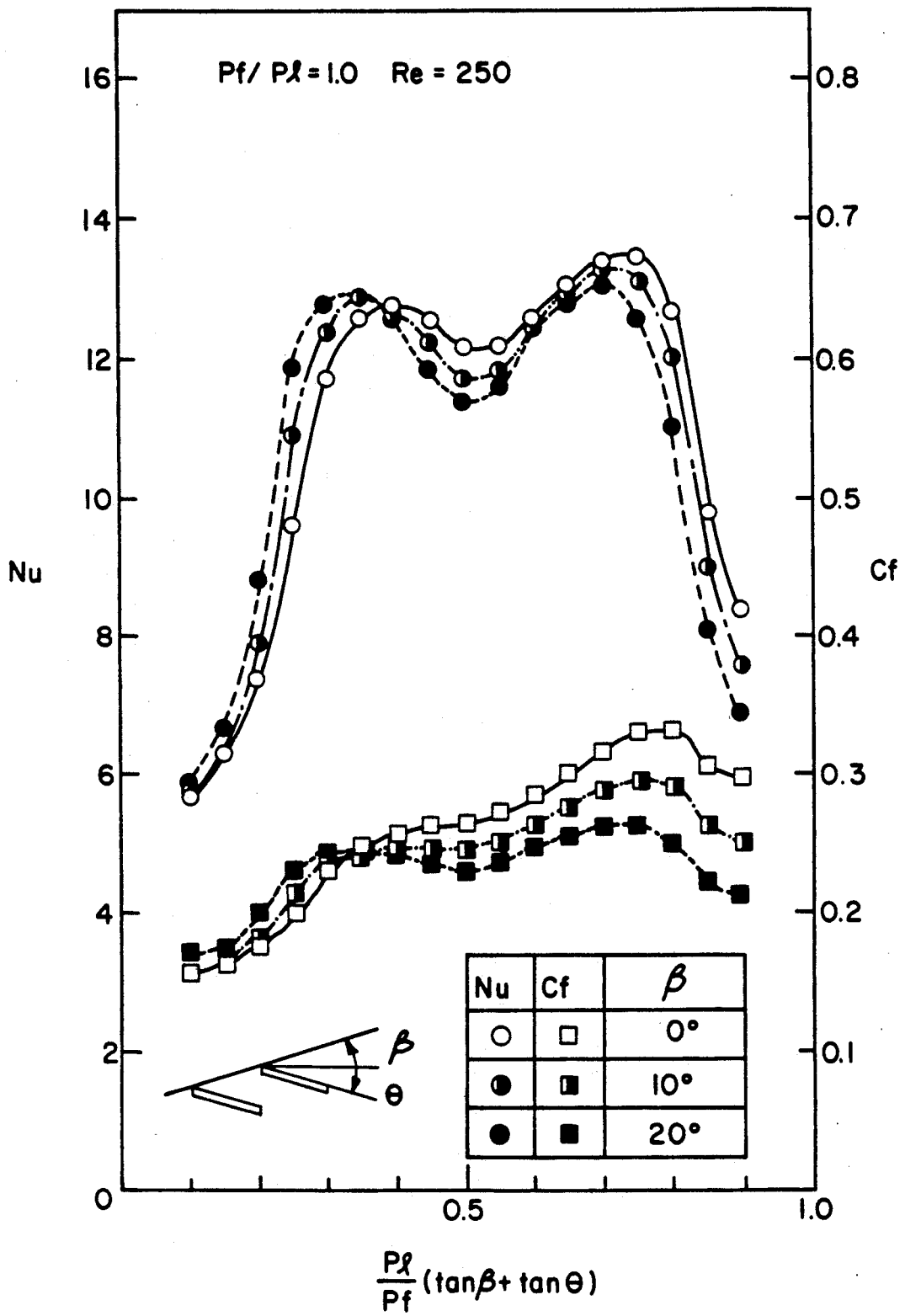
Figure 14:
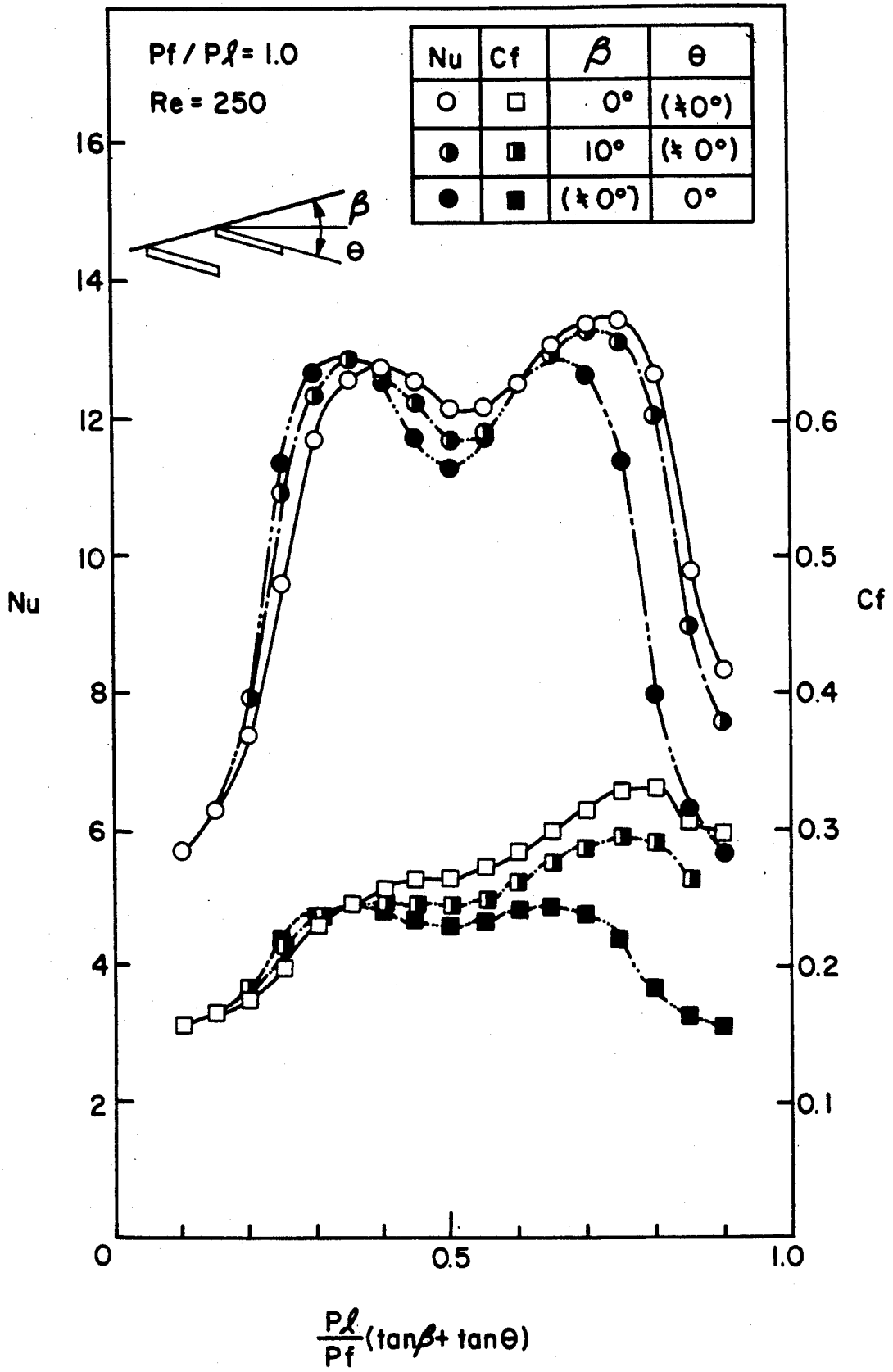

Nusselt number Nu and a coefficiency of resistance Cf;

FIGS. 11(*a*) through 11(*c*) are cross-sectional views of fins having a tilt angle;

FIG. 12 is an enlarged cross-sectional view of louvers of fins having a tilt angle;

FIGS. 13 and 14 are diagrams showing a relation of $$\frac{Pl}{Pf} (\tan \beta + \tan \theta),$$

Figure 15:
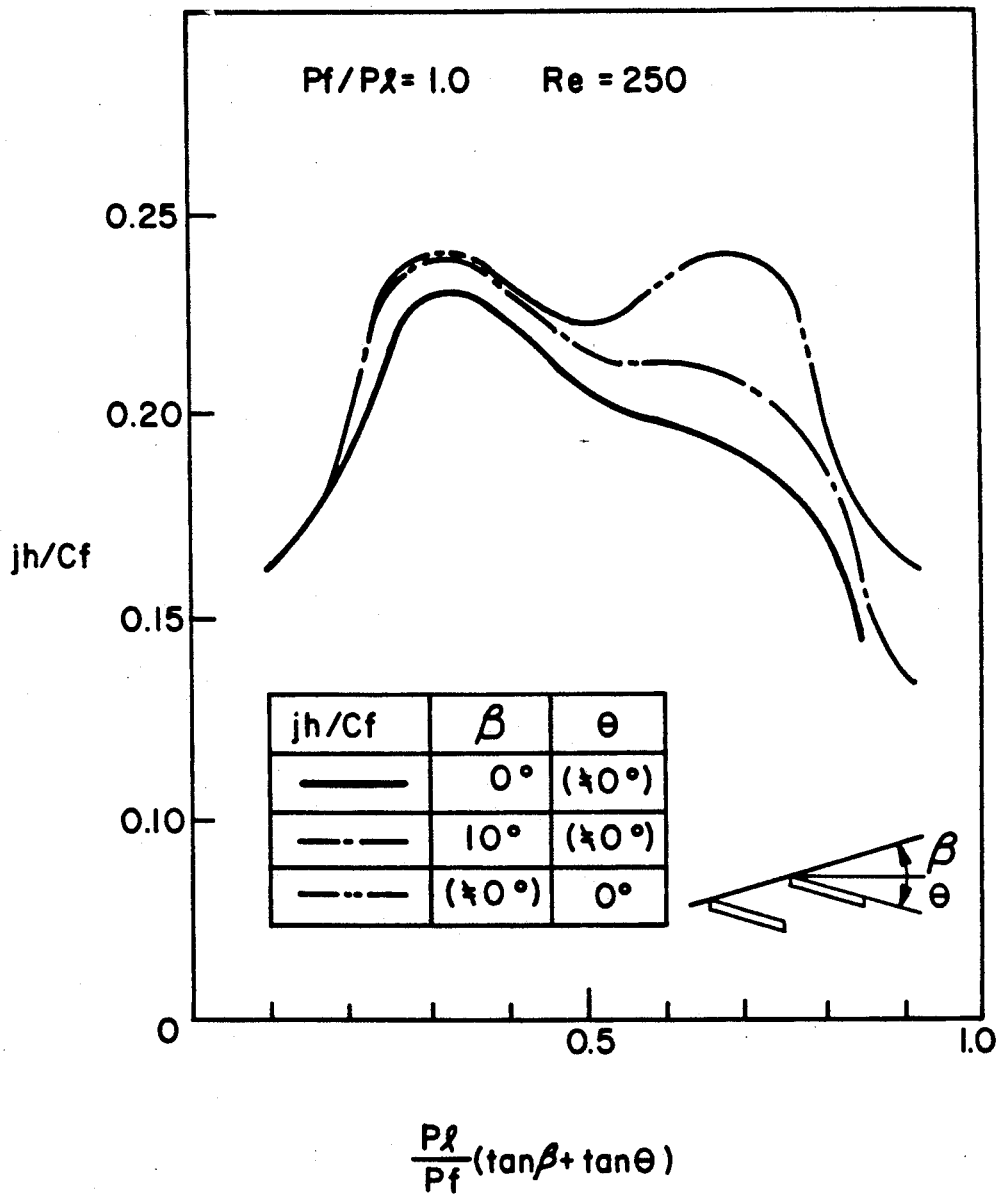
Figure 16:
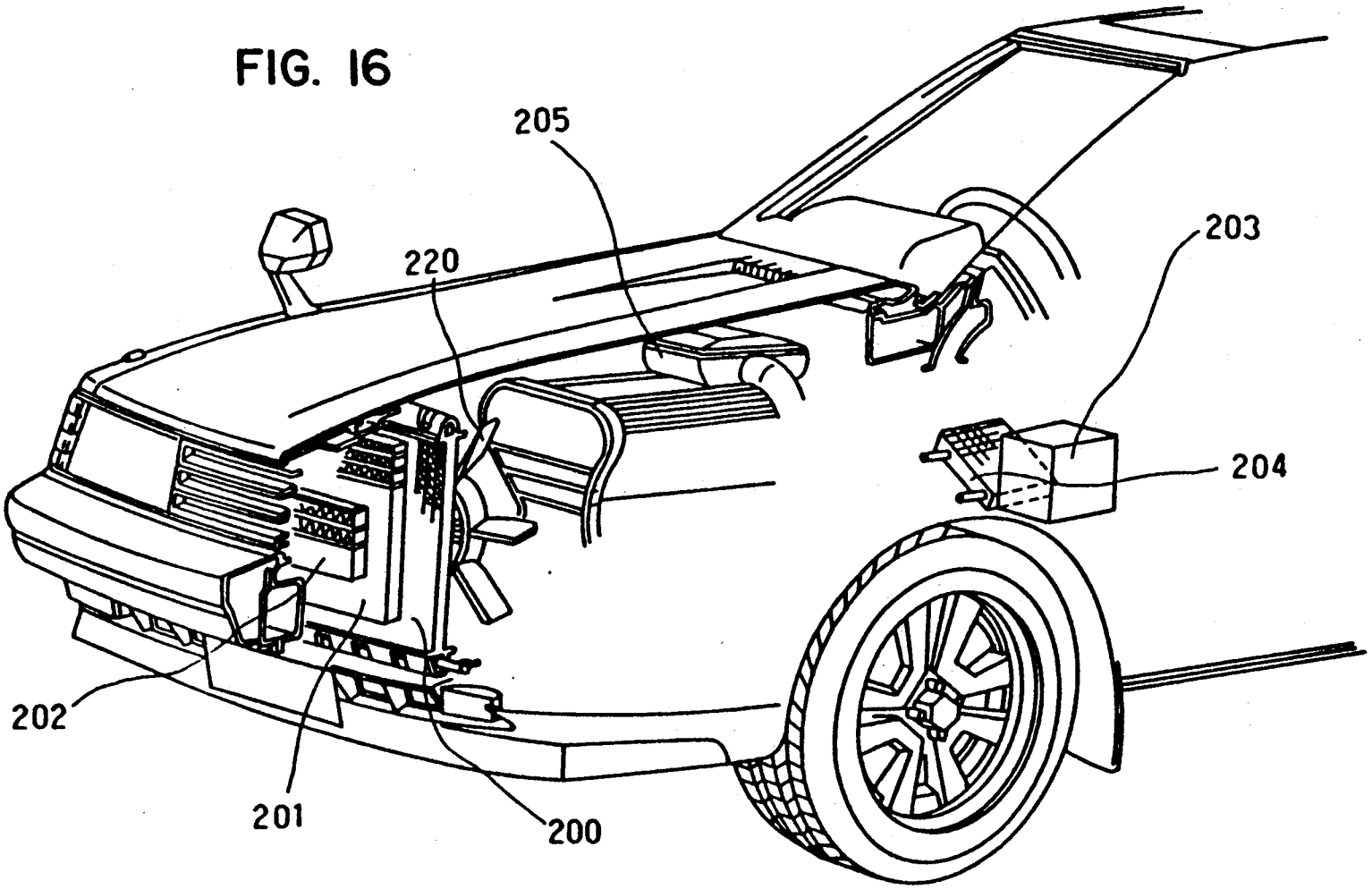
Figure 17:
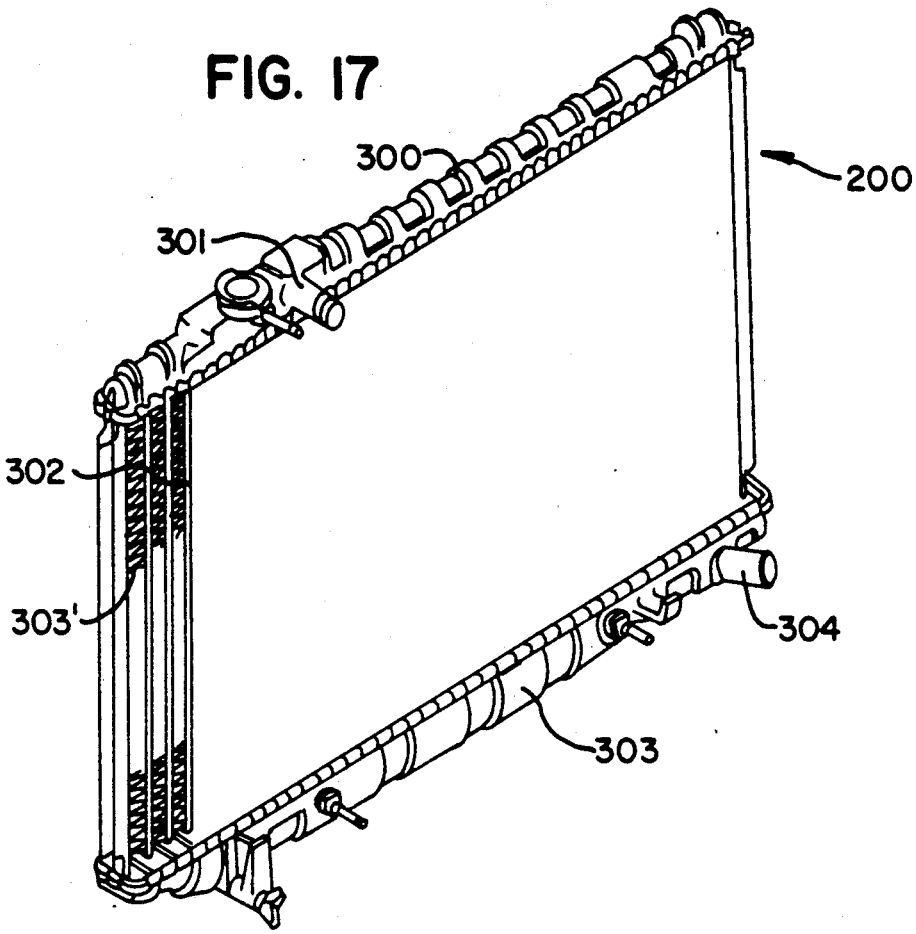
Figure 18:
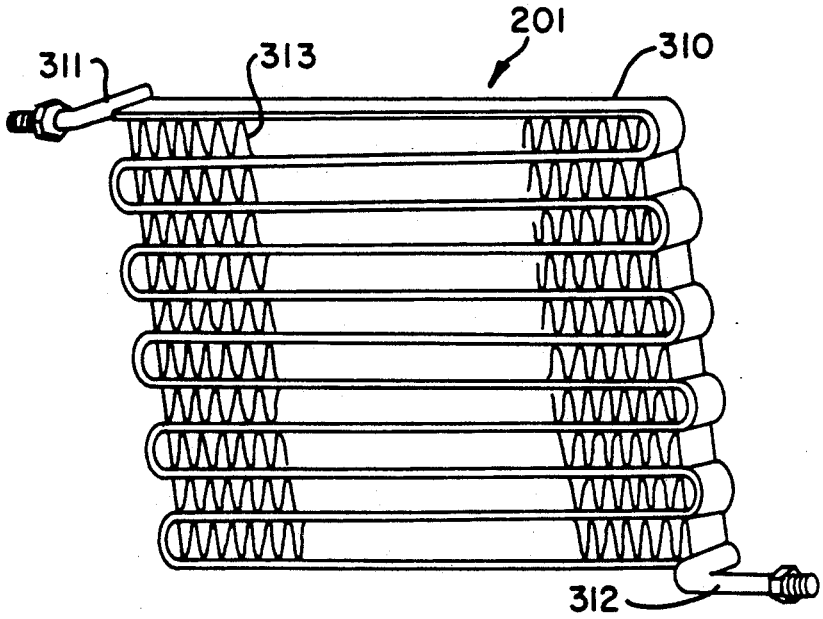
Figure 22:
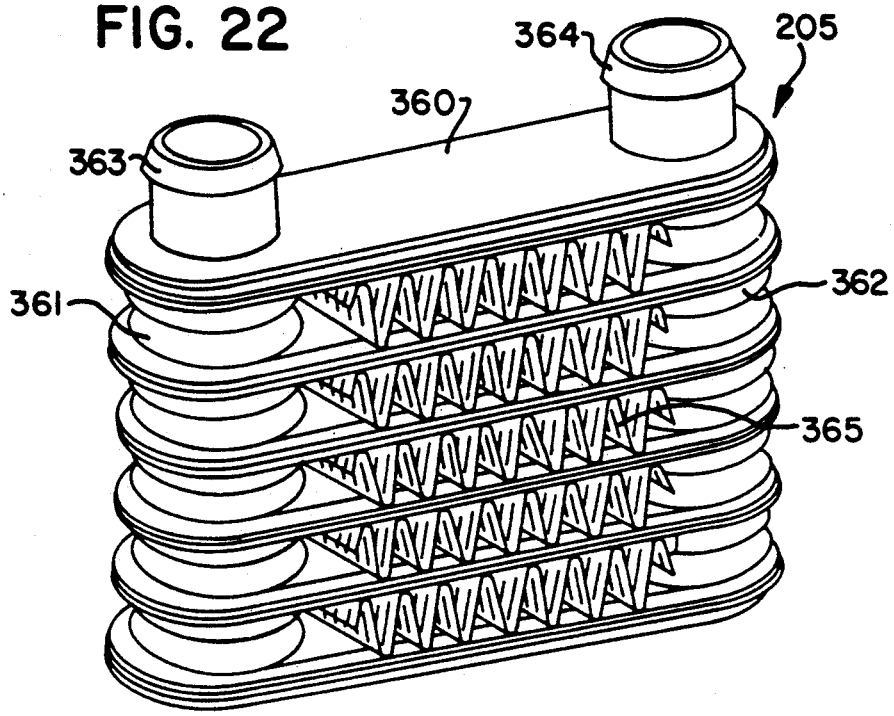
Figure 23:
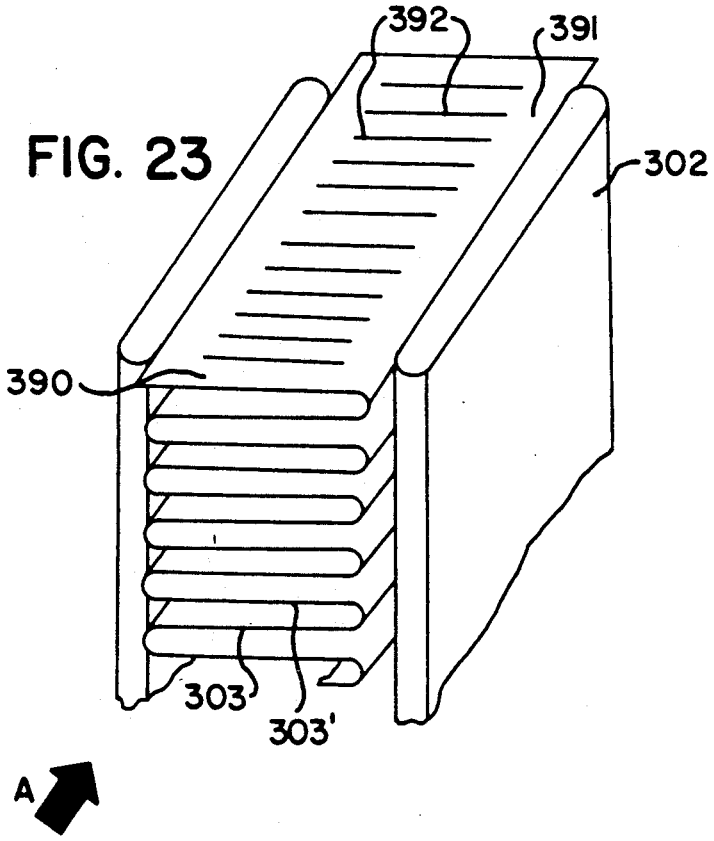
Figure 24:
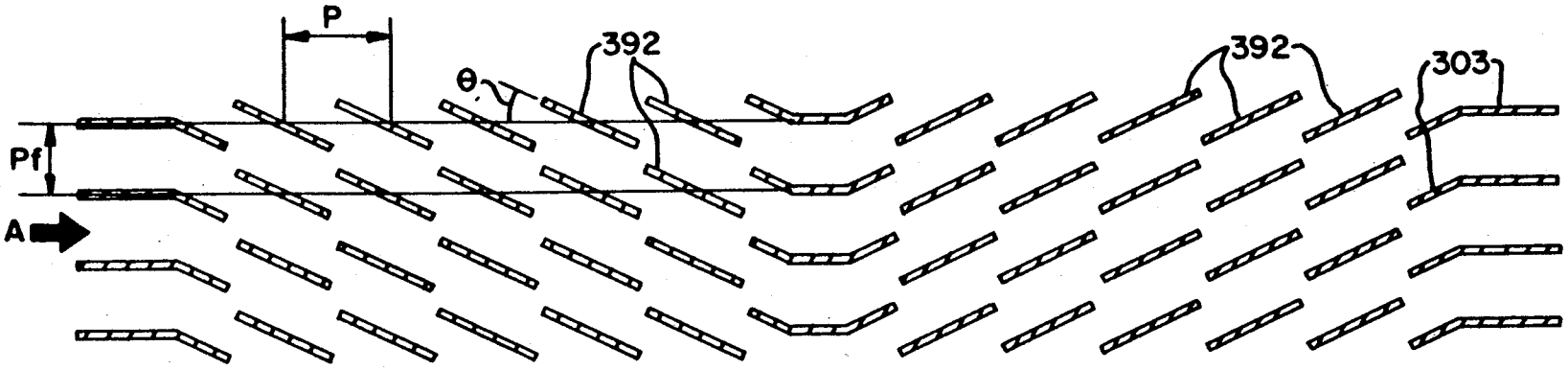
Figure 26:
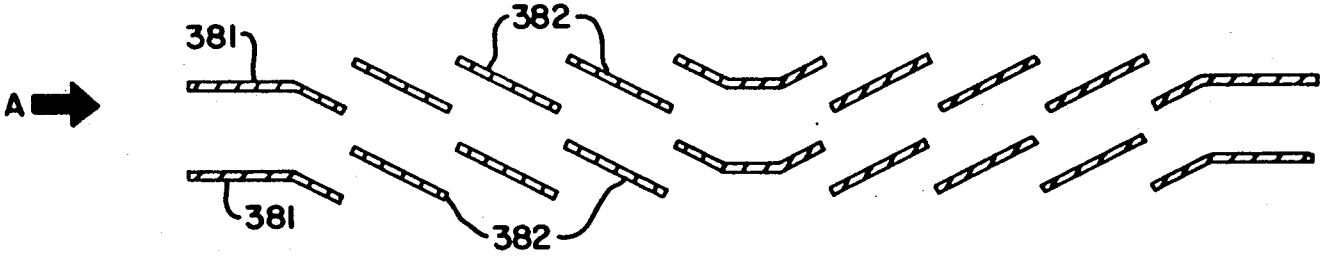
Figure 28:
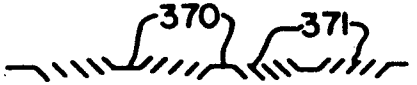
Figure 27:
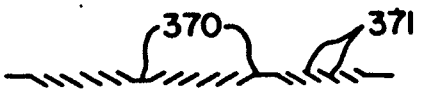
Figure 25:
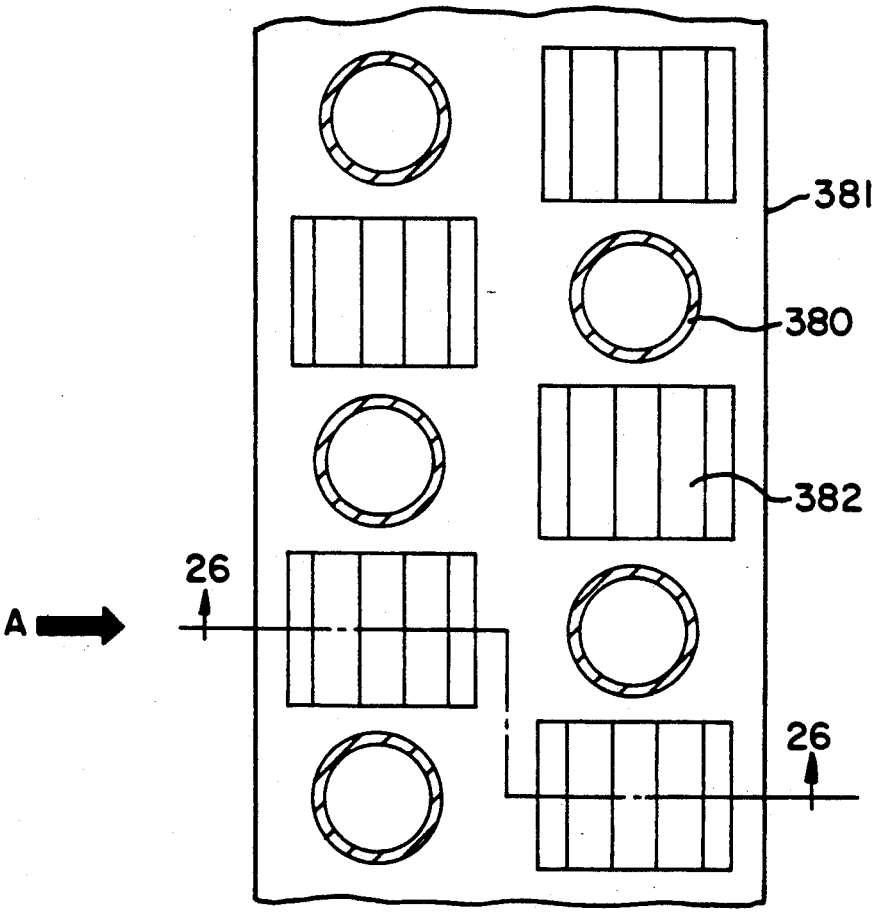

Nusselt number Nu and a coefficiency of resistance Cf;

FIG. 15 is a diagram showing a relation of $$\frac{Pl}{Pf} (\tan \beta + \tan \theta)$$

and a heat transfer efficiency considering a pressure loss;

FIG. 16 is a schematic view of the interior of an automotive engine room;

FIG. 17 is a schematic view of a radiator for an automobile;

FIG. 18 is a schematic view of a condenser for an automobile;

FIG. 19 is a schematic view of an oil cooler for an automobile;

FIG. 20 is a schematic view of an evaporator for an automobile;

FIG. 21 is a schematic view of a heater core for an automobile;

FIG. 22 is a schematic view of an inter cooler for an automobile;

FIG. 23 is a schematic view of tubes and a fin of a radiator;

FIG. 24 is a cross-sectional view of a fin shown in FIG. 23;

FIG. 25 is a cross-sectional view of a plate fin and tubes;

FIG. 26 is a cross-sectional view taken along the line 26—26 of FIG. 25;

FIGS. 27 and 28 are cross-sectional views of louvers; and

Figure 29:
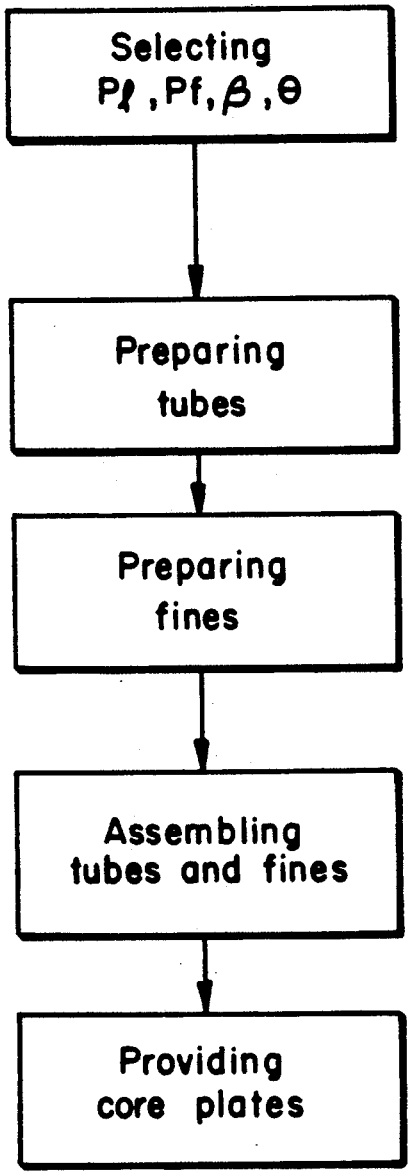

FIG. 29 is a chart showing a process of assembling a heat exchanger.

FIG. 16 shows heat exchangers to which the present invention is applied. A radiator 200, a condenser 201 and an oil cooler 202 are disposed at a front portion of an engine room of an automobile to receive cooling air. The condenser 201 is for condensing a refrigerant of an air conditioner. A fan 220 is provided behind the radiator 200 for generating a cooling air.

An evaporator 203 and a heater core 204 are also disposed in the automobile. The evaporator 203 is for evaporating the refrigerant of the air conditioner and cooling the air. The heater core 204 is disposed in a duct (not shown) downstream of the evaporator 203 and heats the air passed through the evaporator 203. An inter cooler 205 cools the air which is supplied to the engine.

Each of those heat exchangers is explained hereinafter with reference of FIGS. 17 through 22. FIG. 17 shows the radiator 200. Numeral 300 represents an upper tank into which an engine coolant is introduced through an inlet 301. The engine coolant in the upper tank is distributed into each of the tubes 302 and then flows into a lower tank 303. Corrugated fins 303' are bonded to the tubes 302 by soldering and accelerates the heat exchanging of the air passing through the fins 303' and the engine coolant flowing in the tubes 302. The engine coolant in the lower tanks 303 flows toward the engine through an outlet 304.

FIG. 29 shows a process of assembling or making such a radiator or any of the other heat exchangers discussed herein. At first, the values of parameters Pl, Pf, $\beta$ and $\Theta$ are determined so as to satisfy the expression:

$$0.2 \leqq \frac{Pl}{Pf} (\tan\beta + \tan\theta) \leqq 0.45$$

If the expression is not satisfied, one or more of the parameters is adjusted until the expression is satisfied.

Then, a plurality of tubes and a plurality of fins are prepared. Each of the fins has a plurality of louvers for which the width and tilt angle are preliminarily determined according to the above expression. After the tubes and the fins are assembled in such a manner that the fin pitch Pf and the fin tilt angle satisfy the above expression, a pair of core plates are provided at both end portions of the tubes. The tubes, the fins and the core plates are preferably made of an aluminum alloy or a copper alloy and are bonded by soldering in a furnace. After they are soldered, a pair of tanks which are made from resin are connected to each of the core plates.

FIG. 18 shows the condenser 201 which has a corrugated tube 310. The tube 310 is made by extruding an aluminum alloy. An inlet pipe 311 is connected to an end of the tube 310 and an outlet pipe 312 is connected to the other end of the tube 310. A corrugated fin 313 is bonded to the tube 310 by soldering. The fin 313 has louvers as well as the fin 303' shown in FIG. 17.

FIG. 19 shows an oil cooler. A tube 320 is made by bonding two plates together. A corrugated fin 321 is soldered to the tube 320. The tubes 320 and the fins 321 are made from aluminum alloy. The oil cooler 302 is connected to a body of the automobile through a plate 322.

FIG. 20 shows the evaporator 203. The evaporator 203 has a corrugated tube 340 and corrugated fins 341 which are disposed between straight portions of tube 340. The tube 340 and the fins 341 are made from aluminum alloy and bonded together by soldering. An inlet pipe 342 is connected to an end of the tube 340 and an inlet pipe 343 is connected to the other end of the tube 340. The evaporator 203 is assembled to the air conditioner in such a manner that the arrow U faces upper space.

FIG. 21 shows the heater core 204. The heater core 204 has an inlet tank 350 and an outlet tank 351 at the upper side and an intermediate tank 352 at the lower side. A plurality of flat tubes 353 are disposed between the inlet and outlet tanks 350 and 351 and the intermediate tanks 352. The corrugated fins 354 are bonded to the flat tubes 353. The engine coolant introduced into the inlet tank 350 through the inlet pipe 355 is distributed to each of the tubes 353 and then flows down into the intermediate tanks 352. The engine coolant in the intermediate tanks 352 flows up into the outlet tank 351 and then flows toward an engine through the outlet pipe 356.

FIG. 22 shows the inter cooler. Tubes 360 are made by bonding two plates. Tank portions 361 and 362 are formed at both sides of the tubes 360. An inlet pipe 363 and an outlet pipe 364 are connected to the uppermost tube 360. Corrugated fins 365 are disposed between tubes 360. The tubes 360 and the corrugated fins 365 are made from aluminum alloy and are bonded together by soldering.

FIG. 23 is an enlarged schematic view of tubes 302 and a fin 303' of the radiator 200. The corrugated fin 303' receives an air flow A and the bent portion 390 of the corrugated fin 301 is connected to the flat tubes 302 thermally. The corrugated fin 303' has a plurality of louvers on its surface. As shown in FIG. 24, the louvers tilt downwardly in the upperstream of air A and tilts upwardly in the downstream of air A. The fins shown in FIG. 24 are parallel to the air flow A, that is, the fin tilt angle is 0°.

Figure 1:
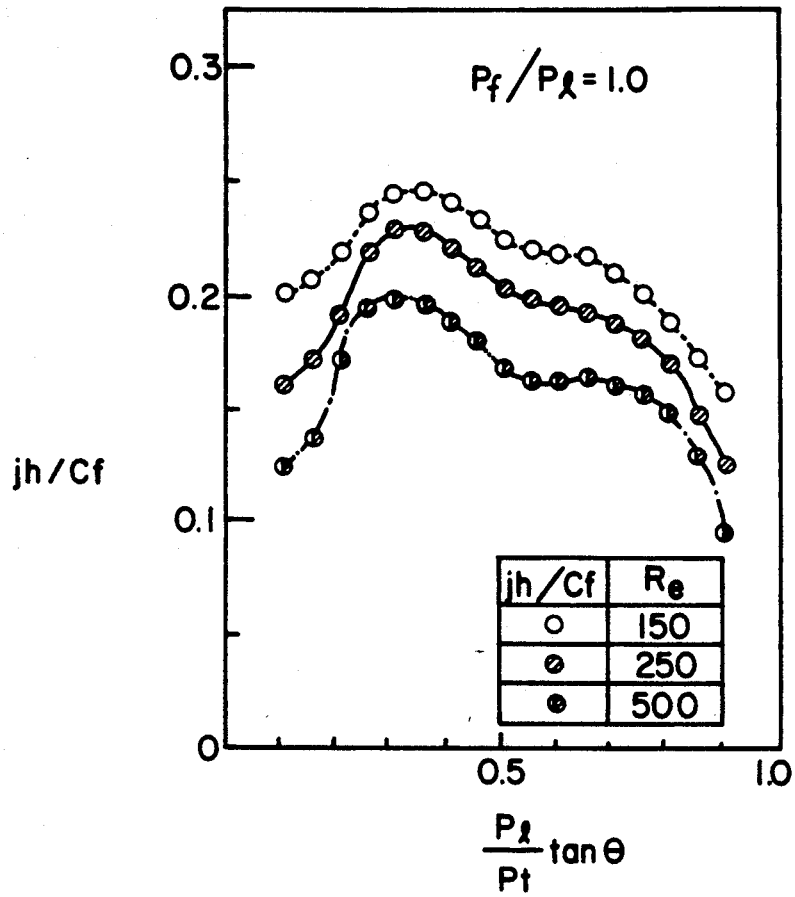
FIG. 1 is a diagram showing an efficiency of a heat exchanger.
Figure 3:
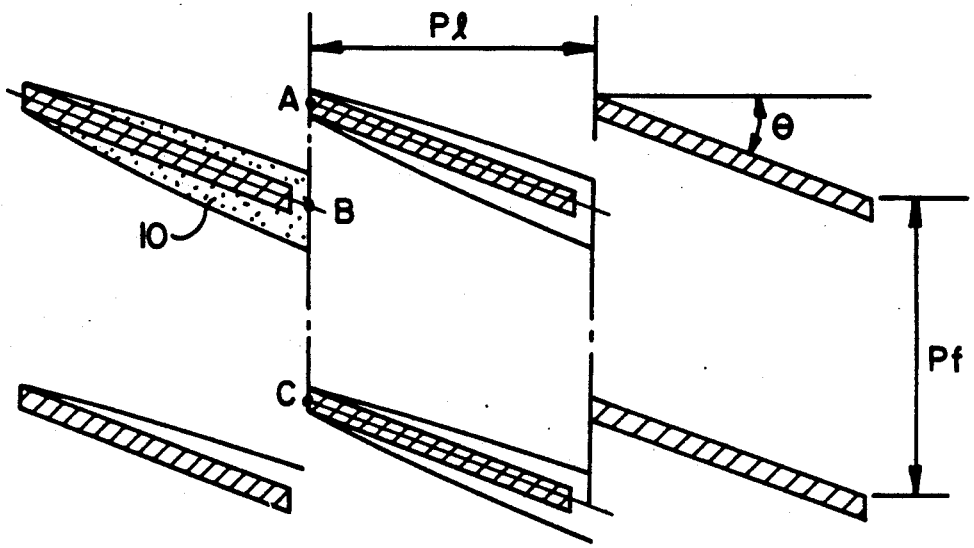
FIG. 3 is a cross-sectional view of fins showing boundary areas of air.
Figure 2A:
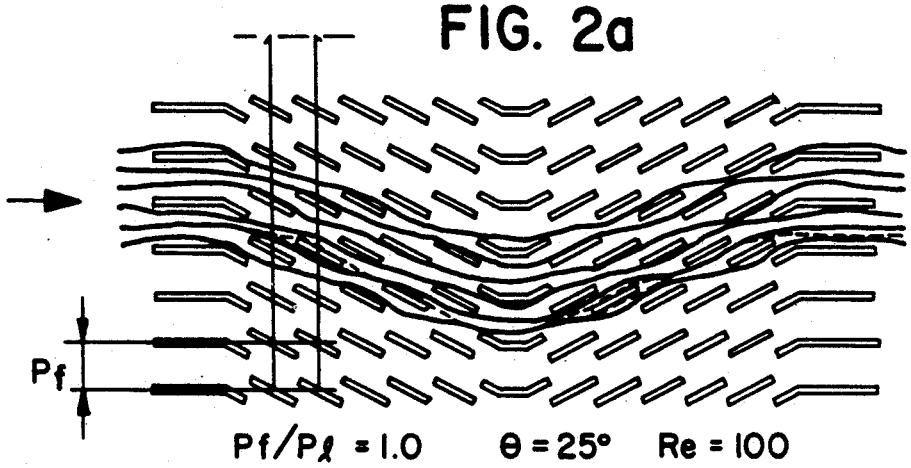
FIGS. 2(*a*) through 2(*f*) show streamlines of fluid flowing through louvers.
Figure 2B:
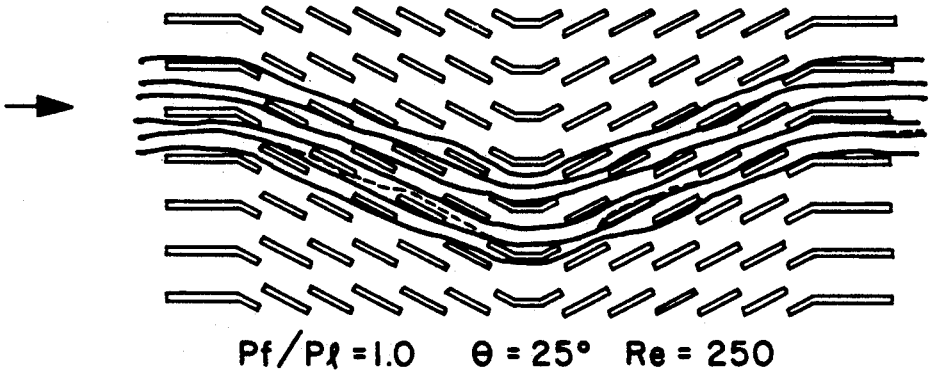
Figure 2C:
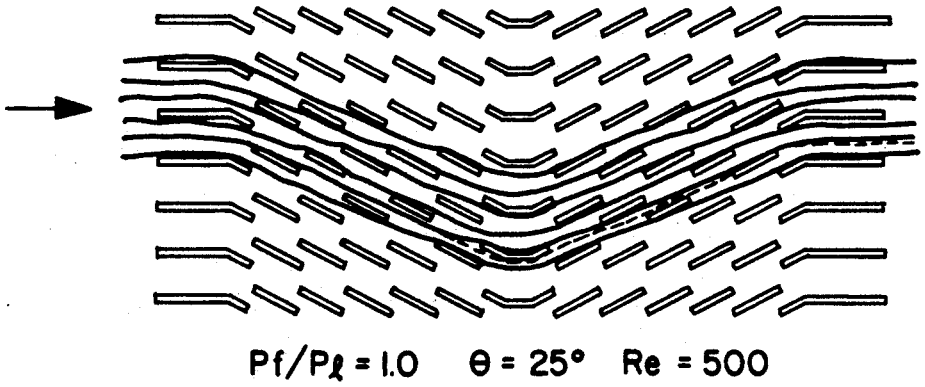
Figure 2D:
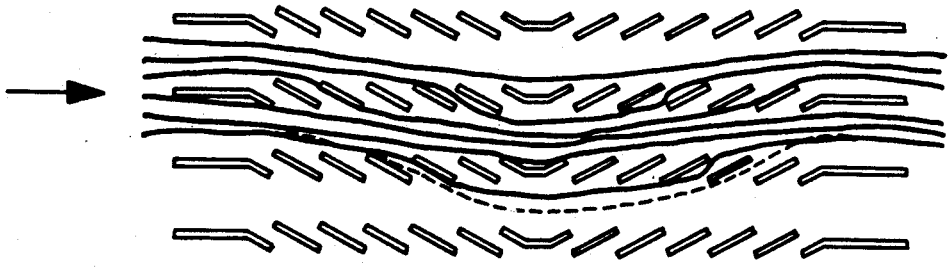
Figure 2E:
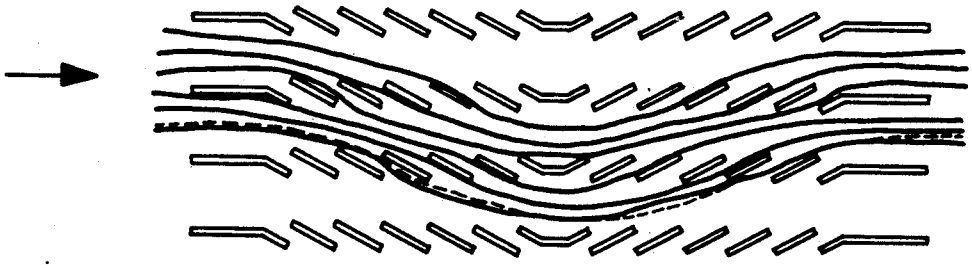
Figure 2F:
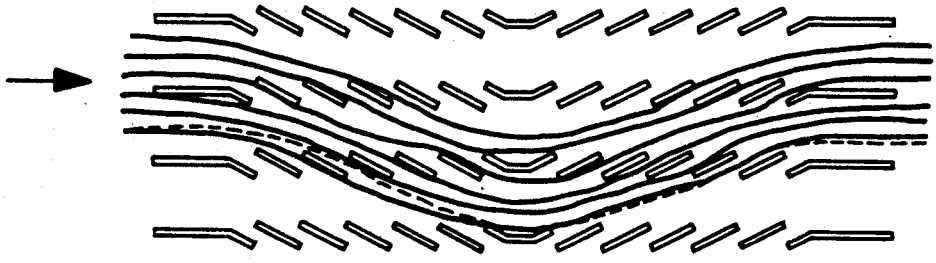
Figure 4:
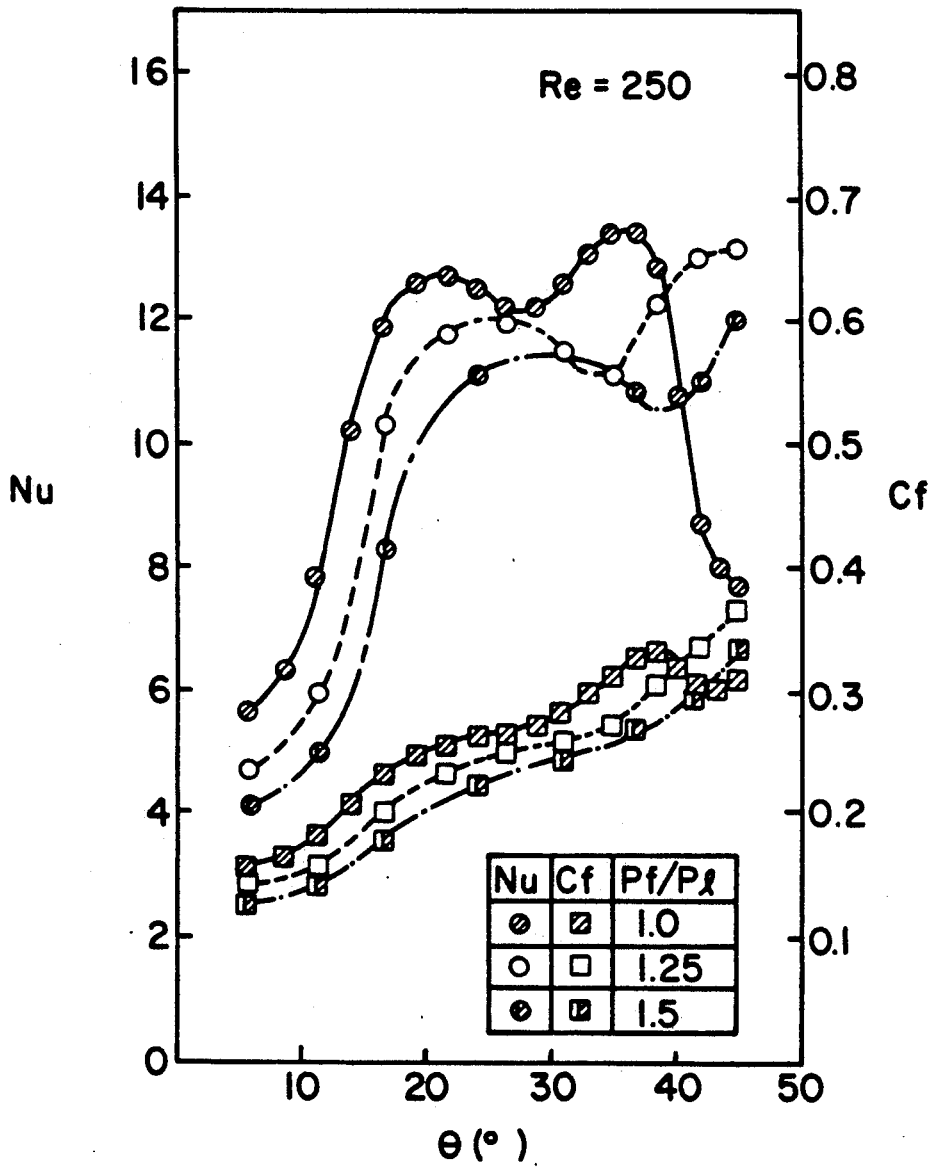
FIG. 4 is a diagram showing a relation of a louver tilt angle, Nusselt number Nu and a coefficiency of resistance Cf.
Figure 5:
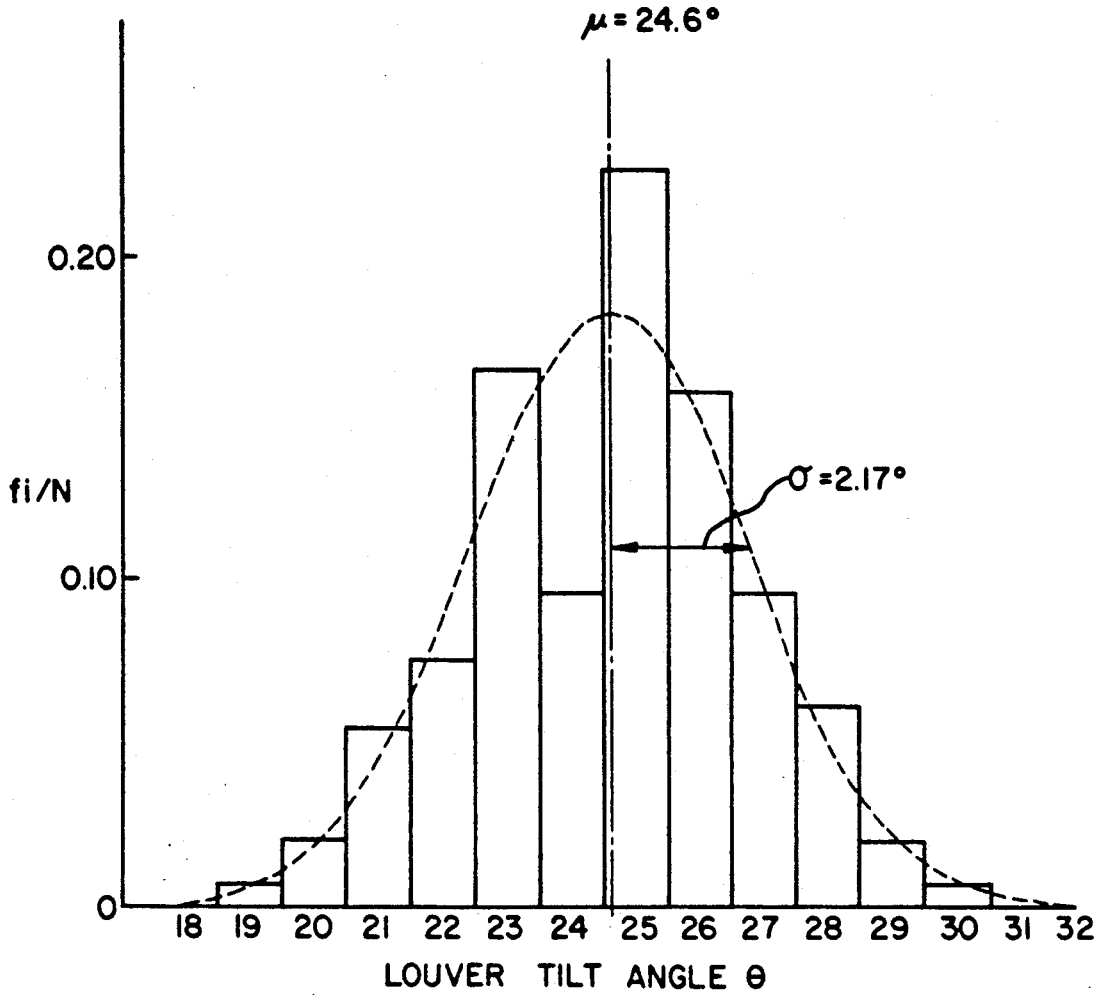
FIG. 5 is a diagram showing the distribution of a louver tilt angle of a heat exchanger.
Figure 6:
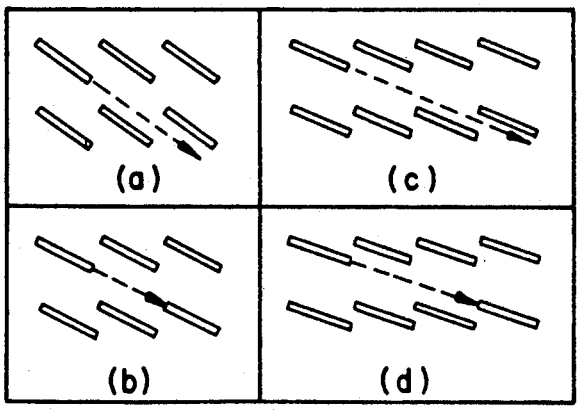
FIG. 6(*a*) through FIG. 6(*d*) are cross-sectional views of fins showing streamlines of air flowing through the louvers.
Figure 7A:
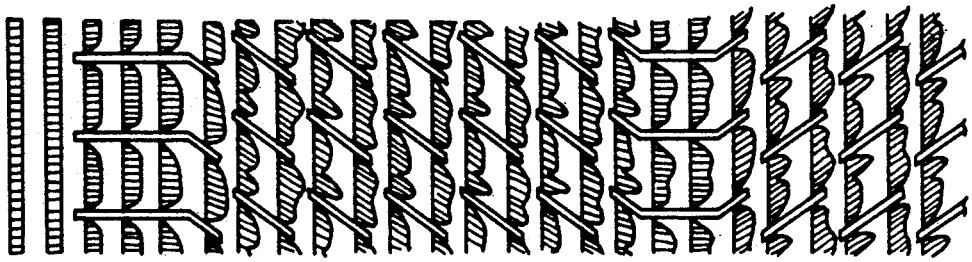
FIGS. 7(*a*) through 7(*d*) are diagrams showing the distribution of velocity of air.
Figure 7B:
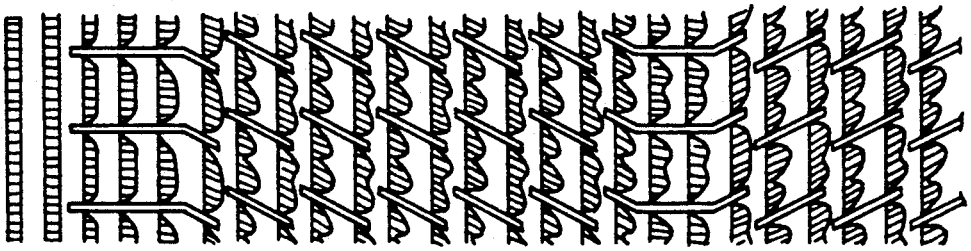
Figure 7C:
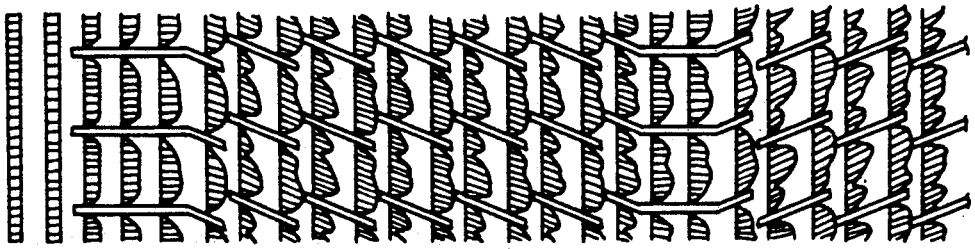
Figure 7D:
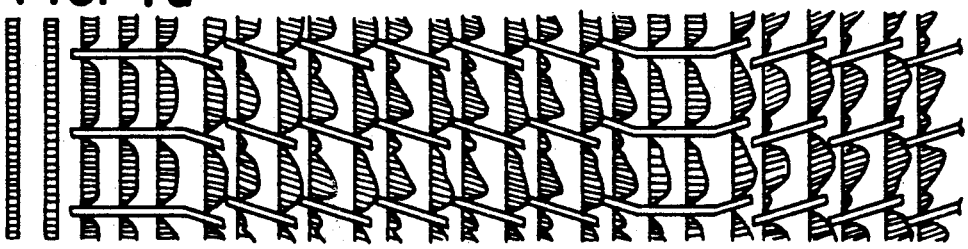
Figure 8:
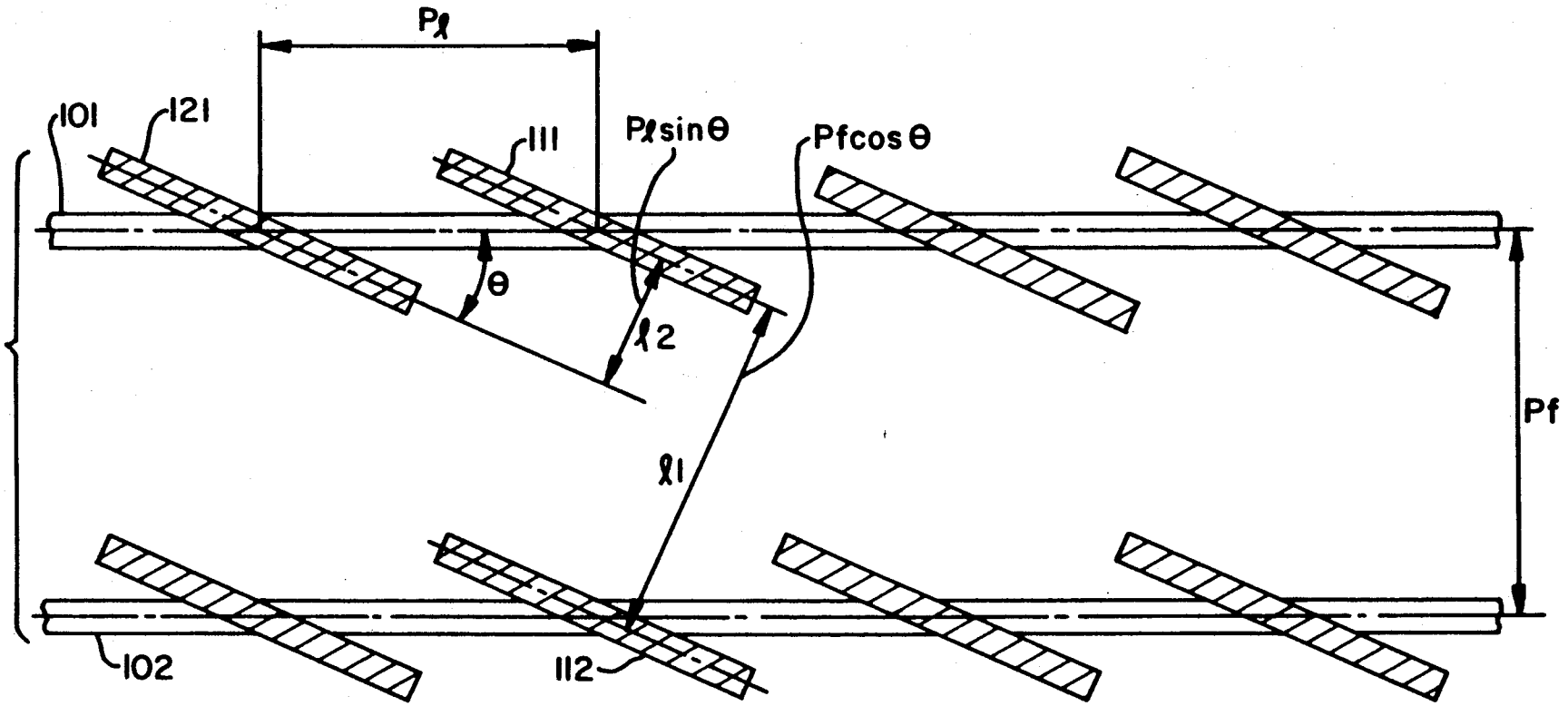
FIG. 8 is a cross-sectional view of louvers of fins.
Figure 10:
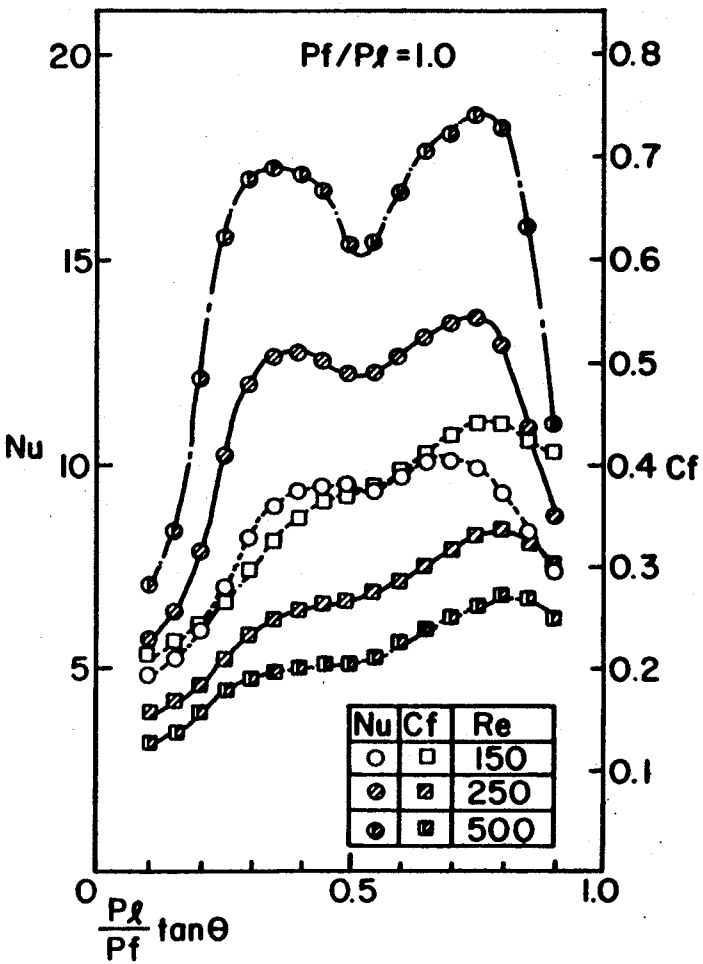
FIGS. 9 and 10 are diagrams showing a relation of $$\frac{Pl}{Pf} \tan \theta,$$
Figure 9:
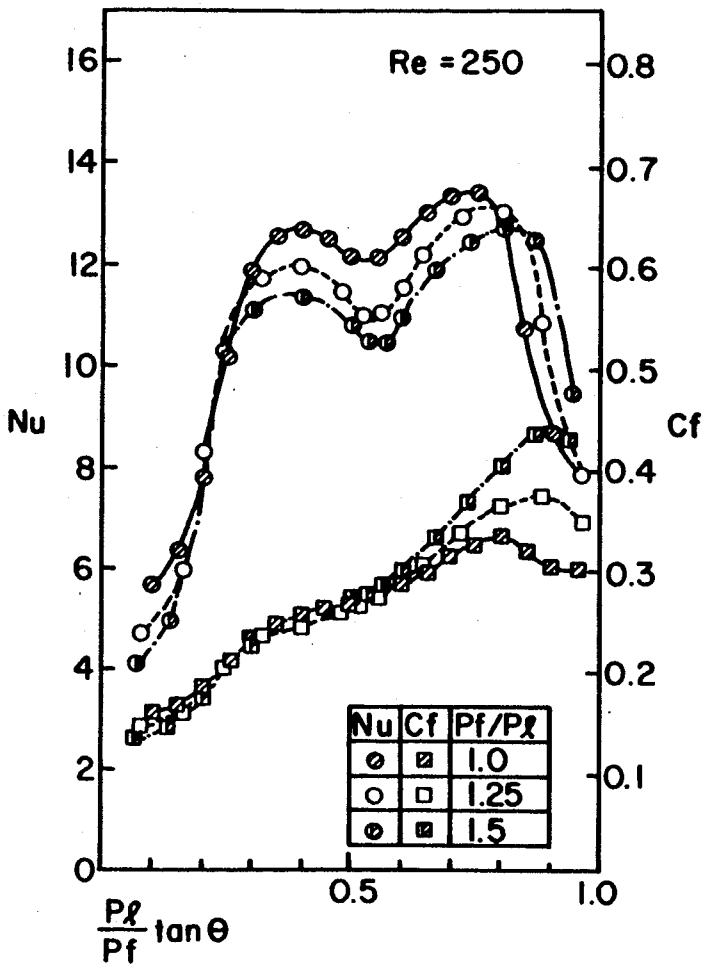

The louvers 392 are formed by supplying a fin strip into an engaging portion of gears which have cutters for forming louvers. A tilt angle of the fin is formed when the fin strip passes through the gears. The louver tilt angle Θ and the fin tilt angle depend on the shape of the gears. As mentioned above with reference of FIG. 5, the louver and fin tilt angles are not always constant values. The louver width Pl is a constant value because louvers are made by louver forming cutters. The fin pitch Pf is a constant value because the fin has a constant number of bent portions per tube 302.

Therefore, the fin pitch Pf and the louver width can be determined precisely and the center values of the fin tilt angle $\beta$ and the louver tilt angle Θ can be determined. The values of the fin pitch Pf, the louver width Pl, the fin tilt angle $\beta$, and the louver tilt angle 8 are determined so as to satisfy the expression, $$0.2 \leqq \frac{Pl}{Pf}(\tan\beta + \tan\theta) \leqq 0.45$$

The radiator shown in FIG. 23 has flat tubes 302 and corrugated fins 303'. The FIG. 18 condensor and the FIG. 20 evaporator have round tubes 380 and plate fins 381 in some cases, as shown in FIG. 25. The round tubes 380 and the plate fins 381 are connected to each other by expanding the round tubes 380 radially. The plate fins 381 have louvers 382. Since the round tubes 380 are disposed in zigzags, louvers 382 are disposed between the round tubes 380. The louvers 382 (FIG. 26) tilt downwardly at the upstream side of air A and tilt upwardly at the downstream side of air A. Since adjacent louvers tilt in the same direction, the streamlines of air are formed by the louvers of adjacent fins. The fin shown in FIG. 26 is not tilted; however, the fin could be tilted at an angle. The present invention can be applied to a heat exchanger which has round tubes and plate fins as shown in FIG. 25.

In FIG. 26, the louvers 382 are comprised of two groups which have different tilt angles on opposite sides of the dividing fins 383. In FIG. 27, the louvers 371 are comprised of three groups, and in FIG. 28, of four groups, with fin dividers 370 in between.

The fluid flowing around the fins and tubes is not limited to air. The heat exchanger can be disposed in liquid.

When the efficiency of a heat exchanger is to be estimated, the fin pitch Pf is measured by measuring the tube length and dividing that length by the number of fin bent portions, i.e., the number of fins or fin rows or columns, and then the louver width Pl is measured. A plurality of the fin tilt angles and the louver tilt angles are measured, and then the center values of the louver tilt angle Θ and fin tilt angle $\beta$ are determined from the distribution of the tilt angles. The values of Pl, Pf, $\beta$ and Θ are substituted in the formula $$\frac{Pl}{Pf}(\tan\beta + \tan\theta).$$

When the value of $$\frac{Pl}{Pf}(\tan\beta + \tan\theta)$$

is within the range of about 0.2 through about 0.45, the efficiency of the heat exchanger is acceptable.

If the efficiency of an assembled heat exchange is to be estimated, it may be necessary to disassemble the heat exchanger to measure the fin and louver tilt angles, in which case care must be taken to maintain those angles undisturbed during the disassembly and their measurements.

Those skilled in the art will think of other ways to practice the invention within the scope of the invention as set forth in the appended claims.

What is claimed is:

1. Method of forming parts for a heat exchanger, comprising the steps of:

selecting values for each of parameters Pl, Pf, $\beta$, Θ, in a heat exchanger wherein Pl is a width of a louver formed in a fin of the heat exchanger, Pf is a fin pitch of a fin of the heat exchanger, $\beta$ is a tilt angle of the fin of the heat exchanger and Θ is a tilt angle of a louver formed in the fin of the heat exchanger;

changing said values until satisfying the expression $$0.2 \leqq \frac{Pl}{Pf}(\tan\beta + \tan\theta) \leqq 0.45;$$

and forming at least said louver and said fin using the changed values of Pl, Pf, $\beta$ and Θ.

2. A method of assembling a heat exchanger comprising the steps of:

determining values of parameters Pl, Pf, $\beta$, Θ in a heat exchanger wherein Pl is the width of a louver formed in a fin of the heat exchanger, Pf is the fin pitch, $\beta$ is a fin tilt angle and Θ is a tilt angle of the louver formed in the fin of the heat exchanger, including selecting values of said parameters to satisfy the expression $$0.2 \leqq \frac{Pl}{Pf}(\tan\beta + \tan\theta) \leqq 0.45,$$

preparing a plurality of the tubes each of which has a through hole through which a heat exchange medium flows, preparing a plurality of fins each of which has a plurality of louvers having a width of said determined value Pl and a tilt angle of said determined value Θ, assembling the tubes and the fins with said determined values of fin pitch Pf, and fin tilt angle $\beta$, and providing a pair of core plates at both end portions of the tubes so that the through hole of the tube opens to the core plate.

3. The method as in claim 2 including the step of making said tubes of an aluminum alloy.

4. The method as in claim 2 including the step of making the tubes of a copper alloy.

5. The method as in claim 3 including the step of making said tubes flat.

6. The method as in claim 2 including the step of making said tubes round.

7. A method of forming parts for a heat exchanger, including determining parameters of fins which are for use between pairs of adjacent tubes in a heat exchanger in such a manner that each of the fins is separated from an adjacent fin by a predetermined fin pitch (Pf) and a base portion of the fin is inclined by a predetermined angle ($\beta$) relative to air flow, including forming the fins with a plurality of louvers having a width (Pl) and a tilt angle ($\Theta$) predetermined in such a manner that the fin pitch (Pf), the louver width (Pl), the louver tilt angle ($\Theta$) and the fin tilt angle ($\beta$) satisfies the expression $$0.2 \leqq \frac{Pl}{Pf} (\tan \beta + \tan \theta) \leqq 0.45.$$

8. The method of forming parts of a heat exchanger as claimed in claim 7, wherein the fins are formed from an aluminum alloy.

* * * * *